US005818013A

United States Patent [19]

Schluckebier

[11] Patent Number: 5,818,013

[45] Date of Patent: Oct. 6, 1998

[54] PROCESS AND DEVICE FOR INDUCTIVE CROSS-FIELD HEATING OF FLAT METALLIC MATERIAL

[75] Inventor: Dieter Schluckebier, Simmerath, Germany

[73] Assignee: Otto Junker GmbH, Simmerath, Germany

[21] Appl. No.: 750,590

[22] PCT Filed: Jun. 13, 1995

[86] PCT No.: PCT/DE95/00757

§ 371 Date: Feb. 13, 1997

§ 102(e) Date: Feb. 13, 1997

[87] PCT Pub. No.: WO95/35013

PCT Pub. Date: Dec. 21, 1995

[30] Foreign Application Priority Data

Jun. 15, 1994 [DE] Germany ..... 44 20 553.8

[51] Int. Cl.[6] ..... H05B 6/10; H05B 6/44

[52] U.S. Cl. ..... 219/645; 219/646; 219/661; 219/662; 219/675

[58] Field of Search ..... 219/645, 646, 219/656, 661, 662, 671, 675

[56] References Cited

U.S. PATENT DOCUMENTS

| | | | |
|---|---|---|---|
| 4,122,321 | 10/1978 | Cachat . | |
| 4,788,394 | 11/1988 | Vanneste et al. | 219/363 |
| 5,308,946 | 5/1994 | Mohr | 219/645 |
| 5,336,868 | 8/1994 | Schluckebier | 219/675 |

FOREIGN PATENT DOCUMENTS

| | | |
|---|---|---|
| 11 58 194 | 11/1963 | Germany . |
| A 39 28 629 | 3/1991 | Germany . |
| 712066 | 7/1954 | United Kingdom . |
| WO 93/11650 | 6/1993 | WIPO . |

*Primary Examiner*—Philip H. Leung
*Attorney, Agent, or Firm*—Shook, Hardy & Bacon L.L.P.

[57] ABSTRACT

A device for inductive cross-field heating of flat metallic goods has at least one pair of inductors having each one iron core provided with a groove for receiving a lead that extends in the transport direction. The grooves and leads of both inductors of a pair of inductors are mirror symmetrical and the leads of each inductor form two independently switchable lead systems. Each lead system has sections that extend substantially in the transport direction of the metallic goods and whose center lines extend symmetrically to a central axis of the inductor parallel to the transport direction. The individual poles of the lead systems consist of maximum two leads. Each pole of a lead system is arranged between the poles of the other lead system. A uniform temperature distribution in the goods to be heated is achieved by synchronizing the offsetting in time the moments when both lead systems are switched. The substantially symmetrical design of the inductor causes similar conditions to prevail at both edges of the goods even when the goods have various widths. By reducing the power applied by the lead system, which acts essentially on both edges of the metallic goods, the edges may thus be prevented from overheating.

21 Claims, 2 Drawing Sheets

PROCESS AND DEVICE FOR INDUCTIVE CROSS-FIELD HEATING OF FLAT METALLIC MATERIAL

BACKGROUND OF THE INVENTION

The invention relates to a device for inductive cross-field heating of flat metallic material, for example strips and plates, having at least one pair of inductors which form a gap for the material to pass through and whose inductors each have an iron core which has grooves running in the transport direction and each receiving a lead, the grooves and leads of the inductors of a pair of inductors each being mirror symmetrical, and to a process for applying the device.

From DE-A 39 28 629, a device for inductive heating of flat metallic material is known, in which a plurality of independently switchable conductor loops are provided, which each have two conductor parts, the right hand conductor part in each case being just as far away from the right hand edge of the inductor as the left hand conductor part is from the left hand edge of the inductor. By connecting or disconnecting said conductor loops, the effective width of the inductor can be adapted to the width of the material. All the conductor loops switched on are effective at the same time, there is no synchronization.

A device for inductive heating having two lead systems for each inductor is known from PCT/GB 92/02212. In this case, viewed over the width of the metallic material, one lead system generates an approximately sinusoidal course of the induced current flux, the period corresponding to the width of the material. To obtain the desired course and thus to achieve the associated pole width, current flows through a number of adjacent leads of this lead system in the same direction. Owing to the desired matching of the period length and width of the material, the width of the poles is determined by the latter. Said first lead system thus generates an approximately sinusoidal course of the temperature in the material to be heated. The second lead system then likewise generates a sinusoidal course of the induced current flux over the width of the material to be heated, but offset by about $\pi/4$ compared to the first lead system, with the result that particularly those places of the metallic material which were previously minimally heated by the first lead system are subjected to the greatest heating by said second lead system. For this purpose, the two lead systems can be switched one after the other in time. In this case, operating only one lead system would result in a widely differing temperature distribution and would not be able to be accepted.

The disadvantage of this arrangement consists in the fact that the sinusoidal distribution of the induced current flux predetermined by the inductor only matches a specific width of the metallic material to be heated. Moreover, in this device, complex measures must be taken to avoid overheating of the edges in the metallic material.

SUMMARY OF THE INVENTION

The object of the present invention is now to specify a device of the type mentioned at the beginning and a process for operating this device, with which a temperature course which is as uniform as possible is achieved in the metallic material to be heated and overheating of the edges is avoided.

In a device of the type mentioned at the beginning, the solution of this object is achieved in that the leads of an inductor each have two independently switchable lead systems, each lead system having lead sections which run in the transport direction and whose centre lines are arranged symmetrically with respect to an axis which is central in relation to the inductor and runs parallel to the transport direction, in that the individual poles of the lead systems are formed by a maximum of two leads, and in that a pole of one lead system is arranged in each case between the poles of the other lead system.

According to the invention, the procedure applied with this device is that the two lead systems are switched synchronously and offset in time with respect to one another.

Since a maximum of two leads form one pole, the poles can be of narrow design so that the temperature distribution, viewed over the width of the metallic material, thus already has quite a high uniformity. The second lead system now lies with its poles between the poles of the first lead system and generates a maximum density of the induced eddy currents offset in time particularly at those places at which the first lead system produced a minimum density. Evening out of the temperature course thus occurs. The two lead systems are switched one after the other in time since, with a simultaneous application of current, the efficiency of the inductor would be reduced owing to the distances which would then be short between two adjacent leads through which current flows simultaneously. The successive switching of the two lead systems thus brings about a doubling of the density of the inductor lines almost without loss in the efficiency of the inductor.

Since the inductor is constructed to be substantially symmetrical relative to a central axis of the inductor pointing in the transport direction, the conditions at the edges of the material to be heated can be kept the same on both sides even in the case of varying widths of the material to be heated. In the case of a course of the leads not running in a straight line, the required symmetry refers to center lines of the lead sections which, seen in the transport direction, run from one end of the inductor to the other.

Since, owing to the symmetry, the conditions at both edges of the metallic material match, action can be taken equally at these edges, e.g. to avoid overheating of the edges. For instance, since both lead systems are independently switchable, specifically that lead system which acts especially on these edge zones can on average over time be acted upon with a lower capacity.

The device according to the invention can also be of such a design that the individual poles of one lead system are each formed by two leads, and the poles of the other lead system are each formed by one lead.

As a result, the efficiency of one lead system is increased due to the increased pole width.

Moreover, the device according to the invention can be of such a design that the grooves and leads of the inductors extend in a straight line or in a zigzag or undulating manner.

Furthermore, the device according to the invention can be designed such that the cores of the inductors are divided into core sections in the transport direction.

As a result, the manufacture of expansive inductors is simplified, particularly when individual inductor sections have a different construction from one another, e.g. within the course of the grooves.

Finally, the device according to the invention can also be of such a design that the inductors and the material to be heated can be aligned relative to one another in the center of the inductor.

With such an alignment, a temperature profile of the material to be heated can be assumed, and an even temperature distribution can be set at both edges of this material. As a result, the metallic material can always be aligned relative to the inductor in such a way that the lead systems extend symmetrically to the center of the metallic material. This is a precondition for the uniform heat treatment of both edges of the metallic material.

The process according to the invention can also be performed in such a way that the two lead systems are connected one after the other to the same current source.

However, the process according to the invention can also be performed in such a way that the two lead systems are connected one after the other to separate current sources.

As a result, it is possible to act with different frequencies on the different lead systems. Consequently, to avoid overheating of the edges, a smaller capacity could thus be fed to the lead system which has the greater effect on the edges of the metallic material with an altered frequency.

Furthermore, the process according to the invention can also be performed in such a way that the two lead systems are connected to the respective current source for unequal time periods.

As a result, even at identical frequencies, seen as an average over time, a different capacity can be fed to the different lead systems. For this purpose, the lead system with the lower capacity requirement must be connected to the current source for shorter time periods than the other lead system.

Finally, the process according to the invention can be performed in such a way that the two lead systems are connected to the respective current source with a delay in time.

BRIEF DESCRIPTION OF THE DRAWING

Embodiments of the device according to the invention are explained below with reference to figures, in which.

DETAILED DESCRIPTION OF THE INVENTION

Figure 1:
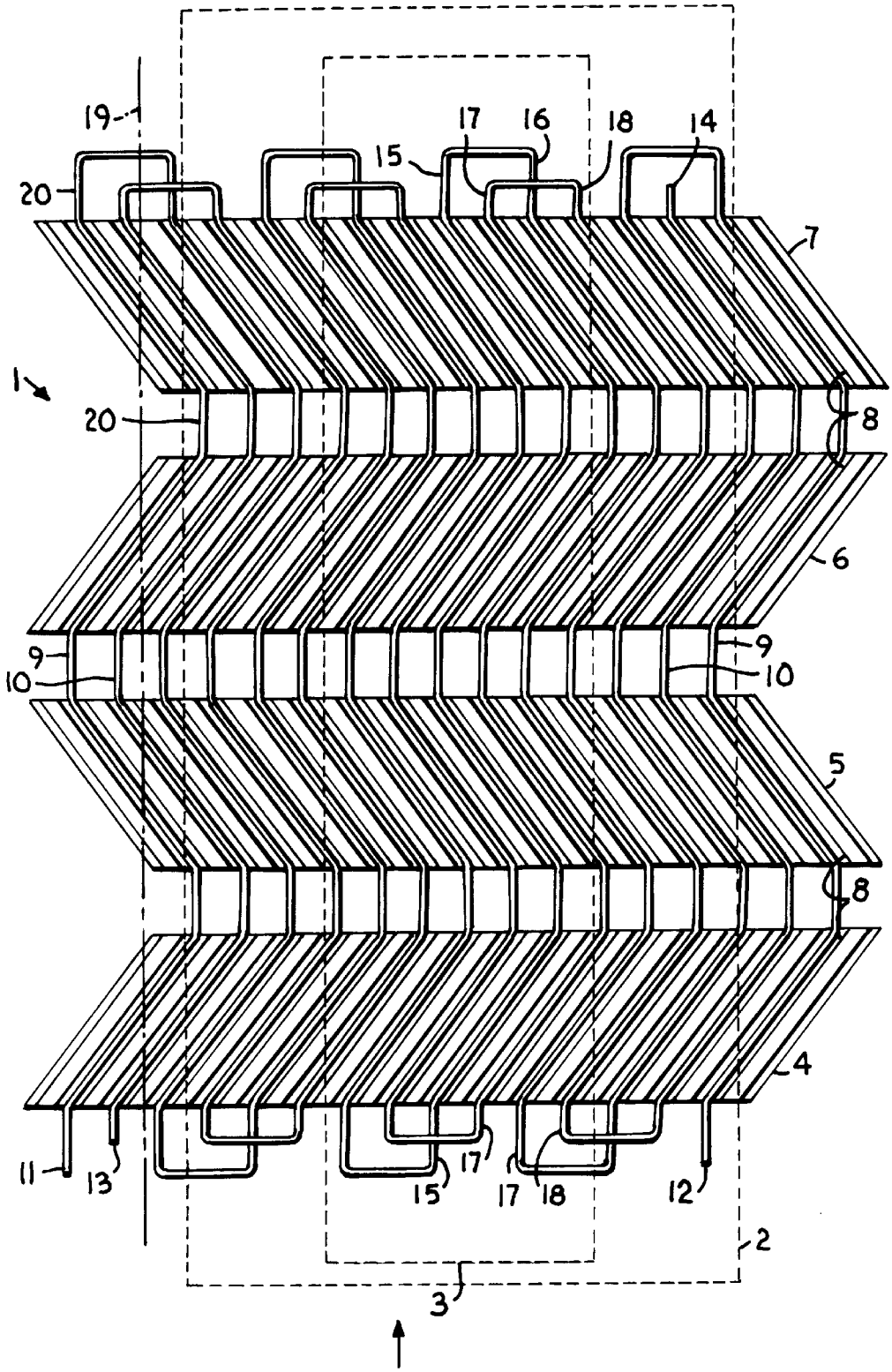
FIG. 1 shows, in a diagrammatic illustration, the plan view of an inductor according to the invention, both lead systems each having one lead for each pole.

FIG. 1 illustrates an inductor 1 and, in dashed lines, the material 2, 3 to be heated in two different widths. The inductor 1 has a core which is divided into four core sections 4, 5, 6, 7. Said core sections 4, 5, 6, 7 have grooves 8 which are inclined in an alternating alignment relative to the transport direction of the metallic material 2, 3, as indicated by the arrow. In the embodiment they extend in a zig-zag manner. Arranged in said grooves 8 are leads 9, 10 of the inductor 1, which consequently likewise extend in a zigzag manner.

The lead 9 has its own current connections 11, 12, and the lead 10 likewise has its own current connections 13, 14, so that two lead systems are formed which are independent of one another.

Considering two adjacent lead sections of a lead system, e.g. the lead sections 15, 16 of the lead 9, extending from one end of the inductor 1 to the other, these sections are defined by opposed current directions. Each of the lead sections of a lead system thus forms one pole of the inductor 1.

If only one of the lead systems, e.g. that of the lead 9, is used for heating the metallic material 2, 3, a fairly uniform heating of the metallic material 2, 3 would already result owing to the narrow poles and also owing to the zigzag conducting of the lead 9. However, since the magnetic field inducing the eddy currents is at a maximum between the poles, a maximum heating of the metallic material 2, 3 also results at these places, so that a slightly periodic temperature course is produced, seen over the width of the metallic material 2, 3.

To further improve said temperature course, the second lead system is therefore used with the lead 10, whose lead sections, as can be seen as an example by the lead section 17, 18 in FIG. 1, extend between the poles of the other lead 9. Owing to this geometrical arrangement of the leads 9, 10, the maximum heating of the metallic material 2, 3 occurs due to the one lead 9 particularly in the zones of the metallic material 2, 3 in which the other lead 10 has generated a temperature minimum.

So that the effects of the two lead systems do not have a negative influence on one another, they are connected to their respective current source (not illustrated here) in a synchronized manner in a successive sequence in time. Owing to this measure, the pole width of the inductor 1 is virtually halved without this lowering the efficiency.

Since the two lead systems with their leads 9, 10 can be switched independently of one another, different capacities can be fed to each of them on average in time. This can be carried out, for example, due to the fact that the time period of the application of current to the one lead system is shortened compared to that of the other lead system. However, it is also possible to connect the lead systems to two different frequency converters (not illustrated here) and to feed them with different frequencies.

Applying different capacities to the different lead systems on average in time can be useful, in particular to avoid overheating of the edges of the metallic material 2, 3. Owing to the spatial boundary of the metallic material 2, 3, increased eddy current densities occur at its edge, as a result of which a temperature increase can occur here. Consequently, it is expedient to apply a lower capacity on average in time to the lead system which acts principally on the edge of the metallic material 2, 3. For this it is important for a specific lead system, for example that of the lead 9 to act on one edge of the metallic material 2, 3 in the same way as on the opposite edge, i.e. for the arrangement of the inductor leads 9, 10 to be substantially symmetrical to the central axis of the metallic material 2, 3. In the case of the course of the leads 9, 10 not being straight, this requirement for symmetry applies to the center lines of the lead sections extending from one end of the inductor to the other. Such a center line 19 is illustrated in FIG. 1 for the lead section 20 of the lead 9. This requirement for symmetry which not only relates to the edge zone of the inductor 1 is particularly advantageous if the inductor 1, as illustrated in FIG. 1, serves to heat metallic material 2, 3 of varying width.

Figure 2:
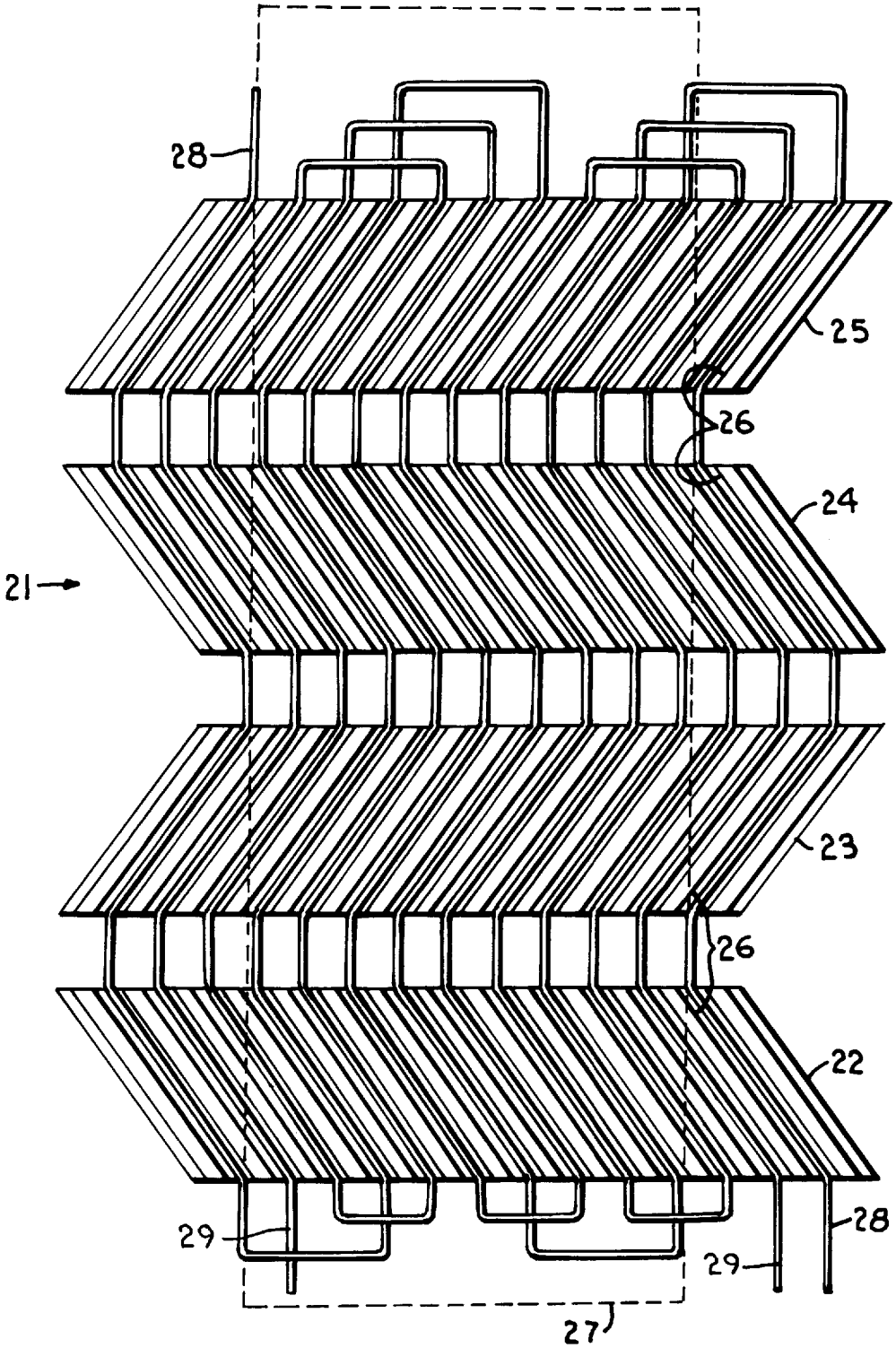
FIG. 2 shows an illustration according to FIG. 1, one lead system having two leads for each pole and the other lead system having one lead for each pole.

FIG. 2 shows an inductor 21 whose core is divided into four sections 22, 23, 24, 25 as in the previously described inductor 1, and in which grooves 26 likewise extend at an angle to the transport direction of the material 27 to be heated, as indicated by the arrow. Here too, there are two lead systems which are independent of one another with the leads 28, 29. In contrast to the inductor 1 described previously, however, here one lead system, that of the lead 29, has two lead sections for each pole, i.e. two directly adjacent lead sections whose current direction is identical. The poles of the lead 28 consisting of a single lead section extend between the poles of said lead 29.

List of reference numerals

1 inductor
2 material to be heated
3 material to be heated
4 core section
5 core section
6 core section
7 core section
8 groove
9 lead
10 lead
11 current connection
12 current connection
13 current connection
14 current connection
15 lead section
16 lead section
17 lead section
18 lead section
19 center line
20 lead section
21 inductor
22 core section
23 core section
24 core section
25 core section
26 groove
27 material to be heated
28 lead
29 lead

I claim:

1. A device for inductive cross-field heating of flat metallic material comprising at least one pair of first and second inductors, the first and second inductors of said at least one pair of first and second inductors forming a gap for the material to pass through, each of said at least one pair of inductors having at least one core whereby each core contains grooves, said grooves being arranged in an alternating zigzag manner, with each of the said grooves receiving one of a plurality of leads, whereby said leads carry current through said at least one pair of first and second inductors, said grooves and said leads of said first one of said at least one pair of first and second inductors is symmetrical with said second one of said at least one pair of first and second inductors, wherein said leads of one of said at least one pair of first and second inductors form two independently switchable lead systems, each of the said independently switchable lead systems having said leads extending in a direction perpendicular to said at least one pair of first and second inductors, whose center lines (19) are arranged symmetrically to a center axis of the inductor extending parallel wherein a pole formed by the current in said independently switchable lead systems is formed by a maximum of two of said leads wherein said pole of one of said two independently switchable lead systems is arranged between said two independently switchable lead systems.

2. The device as claimed in claim 1, wherein the individual poles of one lead system are each formed by two leads (29), and the poles of the other lead system are each formed by one lead (28).

3. The device as claimed in claim 2, wherein the grooves (8,26) and leads (9, 10, 28, 29) of the inductors (1) extend in a straight line or in a zigzag or undulating manner.

4. The device as claimed in claim 3, wherein said cores of said at least one pair of a first and second inductors are divided into core sections.

5. The device as claimed in claim 3, wherein the inductors (1) and the material (2, 3, 27) to be heated can be aligned relative to one another in the center of the inductor.

6. The device as claimed in claim 2, wherein said cores of said at least one pair of a first and second inductors are divided into core sections.

7. The device as claimed in claim 6, wherein the inductors (1) and the material (2, 3, 27) to be heated can be aligned relative to one another in the center of the inductor.

8. The device as claimed in claim 2, wherein the inductors (1) and the material (2, 3, 27) to be heated can be aligned relative to one another in the center of the inductor.

9. The device as claimed in claim 1, wherein the grooves (8, 26) and leads (9, 10, 28, 29) of the inductors (1) extend in a straight line or in a zigzag or undulating manner.

10. The device as claimed in claim 9, wherein said cores of said at least one pair of a first and second inductors are divided into core sections.

11. The device as claimed in claim 10, wherein the inductors (1) and the material (2, 3, 27) to be heated can be aligned relative to one another in the center of the inductor.

12. The device as claimed in claim 9, wherein the inductors (1) and the material (2, 3, 27) to be heated can be aligned relative to one another in the center of the inductor.

13. The device as claimed in claim 1, wherein said cores of said at least one pair of a first and second inductors are divided into sections.

14. A device as claimed in claim 13, wherein said two independently switchable lead systems are switched synchronously.

15. The device as claimed in claim 13, wherein said two independently switchable lead systems are connected one after the other to a single current source.

16. The device as claimed in claim 15, wherein said two independently switchable lead systems are connected to said single current source for unequal time periods.

17. The device as claimed in claim 16, wherein said two independently switchable lead systems are connected to said single current source with a delay in time.

18. The device as claimed in claim 13, wherein said two independently switchable lead systems are connected one after the other to a separate current sources.

19. The device as claimed in claim 13, wherein the inductors (1) and the material (2, 3, 27) to be heated can be aligned relative to one another in the center of the inductor.

20. A device as claimed in claim 13, wherein said two independently switchable lead systems are switched offset in time with respect to one another.

21. The device as claimed in claim 1 wherein the inductors (1) and the material (2, 3, 27) to be heated can be aligned relative to one another in the center of the inductor.

* * * * *